United States Patent [19]

Kilby et al.

[11] 3,955,354

[45] May 11, 1976

[54] DISPLAY FOR ELECTRONIC CLOCKS AND WATCHES

[75] Inventors: Jack S. Kilby; Robert F. Schweitzer, both of Dallas, Tex.

[73] Assignee: Jack S. Kilby, Dallas, Tex.

[22] Filed: Feb. 11, 1974

[21] Appl. No.: 441,384

[52] U.S. Cl. ..... 58/50 R; 58/127 R

[51] Int. Cl.[2] ..... G04B 19/30; G04B 19/06

[58] Field of Search ..... 58/23 R, 50 R, 127 R

[56] References Cited

UNITED STATES PATENTS

| | | | |
|---|---|---|---|
| 2,542,021 | 2/1951 | Fox | 58/50 R |
| 3,276,200 | 10/1966 | Freeman | 58/50 R |
| 3,456,152 | 7/1969 | Anderson | 58/50 R |
| 3,540,209 | 11/1970 | Zatsky et al. | 58/50 R |
| 3,630,015 | 12/1971 | Lehovec | 58/50 R |
| 3,747,322 | 7/1973 | Eckenrode | 58/50 R |
| 3,754,392 | 8/1973 | Daniels | 58/50 R |
| 3,757,511 | 9/1973 | Burgess et al. | 58/50 R |

*Primary Examiner*—Edith Simmons Jackmon
*Attorney, Agent, or Firm*—Richards, Harris & Medlock

[57] ABSTRACT

An electronic timepiece with minimal power requirements, employing a single ring of individual visual display elements selectively actuated to display hours, minutes, and seconds.

27 Claims, 6 Drawing Figures

SCHMITT TRIGGER
UNIJUNCTION OSCILLATOR
5V REG
+5V

SCHMITT TRIGGER
UNIJUNCTION OSCILLATOR
5V REG
+5V

DISPLAY FOR ELECTRONIC CLOCKS AND WATCHES

FIELD OF THE INVENTION

This invention relates generally to electronic timekeeping devices, and more particularly to a single ring of individual visual display elements selectively actuated to display the time segments hours, minutes, and seconds.

DESCRIPTION OF THE PRIOR ART

Electronic clocks and watches employing light-emitting diodes (LEDs) are known in the prior art. U.S. Pat. Nos. 3,754,392 and 3,757,511 disclose electronic watches featuring displays of seventy-two LEDs arranged in two concentric circles to indicate hours, minutes, and seconds. NAND gate logic has been employed to incorporate low power CMOS components in a two voltage level system with the lower voltage applied to high frequency devices. A driver circuit controls the duty cycle of the display by pulsing a maximum of three diodes in any given second.

Further, electronic clocks and watches employing digital read-out displayed in Arabic or Roman numerals, using LEDs or liquid crystal elements, are old in the art.

It will be appreciated that digital read-out displays provide a precise indication of the time. This is done in a way which may require substantial mental arithmetic on the part of the user. In contrast the hands of a conventional clock frequently serve as a simple form of computer, permitting easy calculation of the time elapsed since a particular event or the time remaining before an event occurs. This quick-glance predilection is a result of long experience with conventional clock faces.

SUMMARY OF THE INVENTION

The present invention is directed to the display of time in a manner which will combine the precise recognition characteristic of the digital read-out with the quick correlation to events provided by the conventional displays.

The invention is further directed to reduction of operating power as compared to electro-mechanical timepieces, or the electronic timepieces employing a digital read-out. Electronic watches and clocks employing a digital read-out require many elements continuously energized for an equivalent display. Electromechanical watches and clocks employing the conventional displays require power to drive hour, minute, and second hands.

The present invention requires a maximum of three LEDs to be energized at any given time to display the hour, minute, and second.

More particularly, in accordance with the invention, a plurality of individual visual display elements are arranged in a single circle. Elements such as light-emitting diodes or liquid crystal display elements are selectively energized to display the hour, minute, and second. The present hour is displayed continuously energized in the appropriate location. The hour location advances to the next hour location as a minute indicator indexes to the 12:00 o'clock position. Minutes are displayed by a flashing element at a rate greater than 1 Hz. Seconds are displayed as a continuously energized element advancing about the circle at one-second intervals. A single ring of elements may thus be used to display hours, minutes, and seconds. When the minute and hour indications are at the same location, both the hour and an immediately adjacent element may be flashed simultaneously.

In a further aspect, there is provided an hour indicator in which an element location is advanced each twelve minutes to provide a more familiar positional display.

In a still further aspect, there is provided an hour and minute coincidence indication in which elements on both sides of the hour indicator flash.

DESCRIPTION OF THE DRAWINGS

For a more complete understanding of the present invention and for further objects and advantages thereof, reference may now be had to the following description taken in conjunction with the accompanying drawings in which.

DESCRIPTION OF A PREFERRED EMBODIMENT

Figure 1:
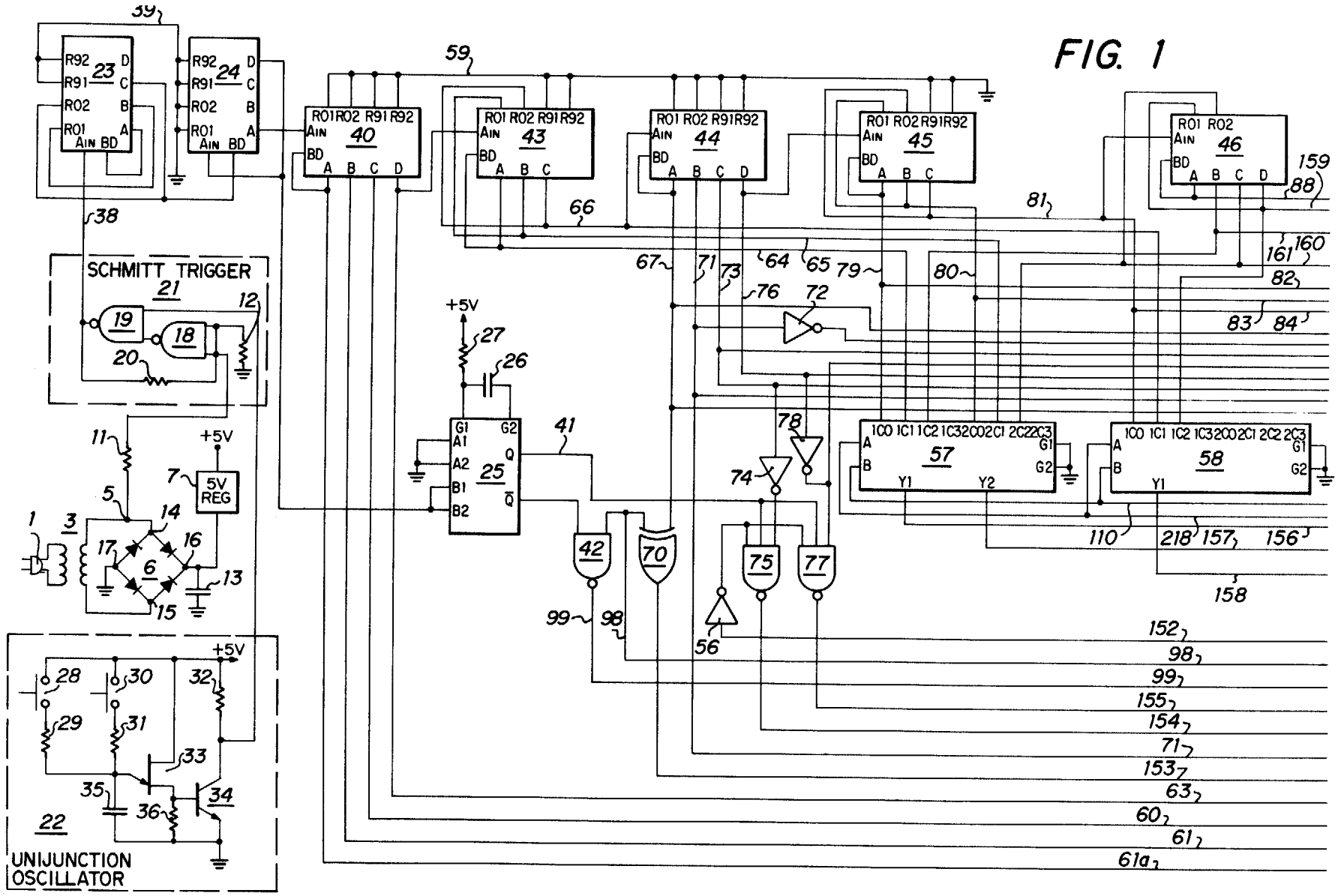
FIGS. 1 and 2 comprise a schematic diagram of the electrical circuit of an illustrative embodiment of the invention.
Figure 2:
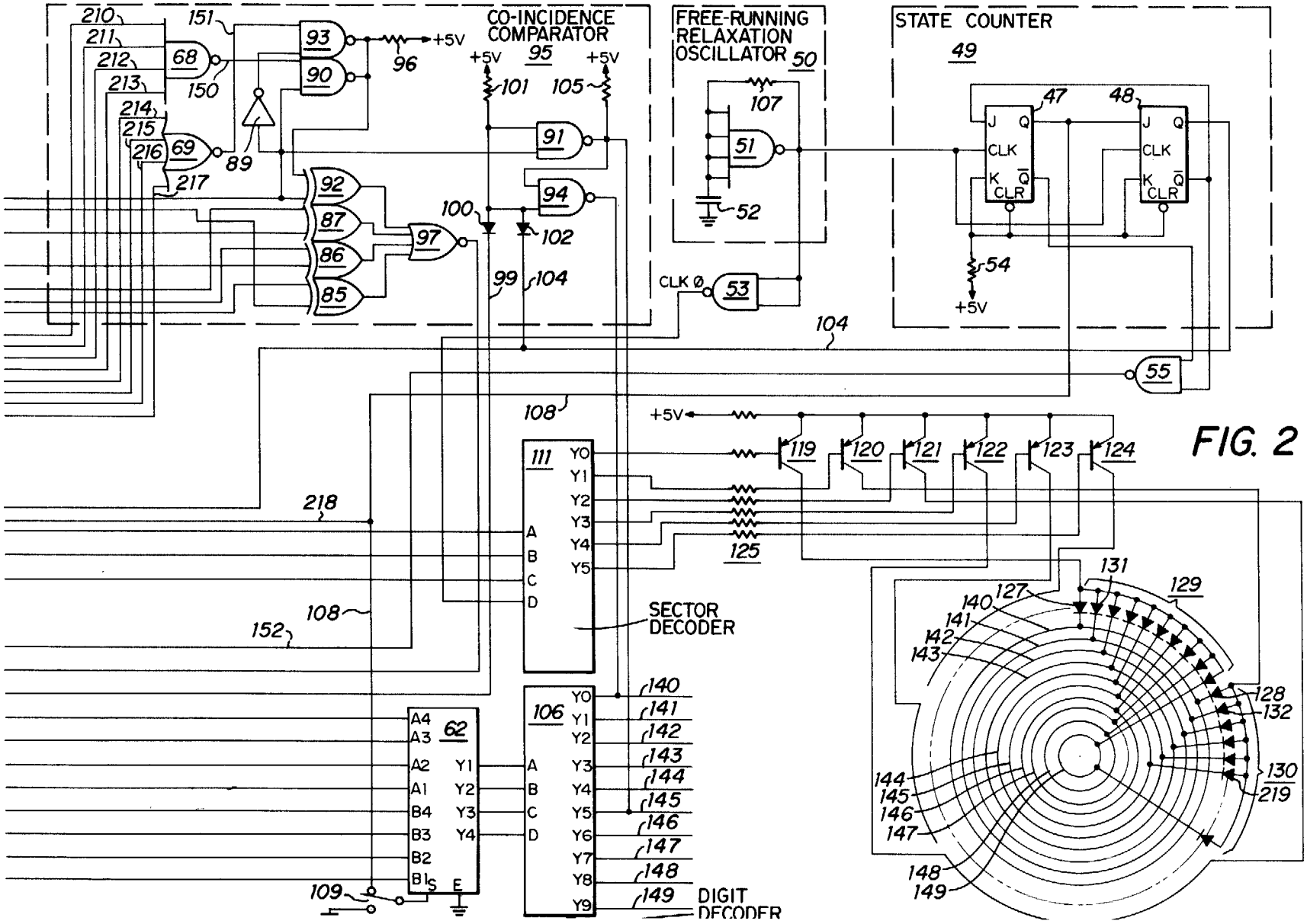

FIGS. 1 and 2

In the embodiment illustrated in FIGS. 1 and 2, the indicator or face 126 of the timepiece has as its significant elements a ring of light-emitting diodes such as the diodes 127, 131, etc. Sixty diodes are formed in the ring as a single circle. The invention then involves suitable control networks for the selective energization of the diodes in the single ring such that the three quantities, hours, minutes, and seconds, can be indicated in a manner which is readily interpretable and provides minimal confusion. A suitable timing source is employed to develop pulses at one pulse per second and at two pulse per second rates. The one pulse per second signal is employed to step the second indicator. The two pulse per second signal is employed to energize the minute indicator. The hour indicator maintains continuous illumination.

As indicated in FIG. 1, the timing source for a nonportable unit utilizing low power TTL circuitry is the sixty cycle supply connected to the unit by way of plug 1 which is connected through transformer 3 to a full-wave rectifier 6.

In portable timepieces such as watches, a battery operated crystal oscillator with a counter chain may be used to provide 1 Hz and 2 Hz reference frequencies to a system utilizing CMOS or injection logic.

Rectifier 16 is connected to one terminal of a capacitor 13, and to the input of a five volt regulator 7 which provides the five volt source referred to throughout the description. The second terminal of capacitor 13 is connected to ground. Node 17 of the full-wave rectifier is also connected to ground.

Rectifier 6 is connected to a Schmitt trigger 21 through a resistor 11. Circuit 21 serves to produce sixty-per-second square wave pulses on line 38. More particularly, resistor 11 is connected to both inputs of NAND gate 18. The output of a NAND gate 19 is connected to the Ain input of a counter 23 and through a resistor 20 to the input of gate 18 which, through a resistor 12, is connected to ground. The output of NAND gate 18 is connected to one input of NAND gate 19.

The second input of NAND gate 19 is supplied from an oscillator 22 which is employed selectively to set the timepiece. Oscillator 22 is a unijunction oscillator. It includes the networks associated with a unijunction transistor 33 and a transistor 34. The emitter of UJT 33 is connected through a resistor 31 to a switch 30. Resistor 29 leads to one terminal of a switch 28. A capacitor 35 leads from the emitter of UJT 33 to ground. The second terminal of switch 28 is connected to the second terminal of switch 30 and to the base 2 of UJT 33. A resistor 32 leads to the collector of transistor 34 and one input of NAND gate 19. Resistor 36 connects the base 1 of UJT 33 and the base of transistor 34 to ground. The emitter of transistor 34 is connected to ground.

Closure of switch 30 serves to produce an output to gate 19 which will permit setting the hour indication on the face 126. Closure of switch 28 produces a signal for the setting of the minute indicator.

The output signal on line 38 then leads to a series of counters 23, 24, 40, 43, 44, 45, and 46. Counter 23 is a divide-by-six counter. Counter 24 is a dual function unit providing a divide-by-ten and a divide-by-five output. The A output of counter 24 is at the rate of one pulse per second. The D output is at a rate of two pulses per second. Counter 40 is a divide-by-ten unit. Counter 43 is a divide-by-six unit. The C output of counter 43 is a one pulse per minute output. Unit 44 is a divide-by-ten unit. Unit 45 is a divide-by-six unit with a C output thereof being at the rate of one pulse per hour. The unit 46 is a divide-by-twelve unit.

Counter 23 is a four flip-flop counter. The A output of counter 23 is connected to the BD (clock) input to a second and a fourth flip-flop therein. The B output is connected to the RO1 terminal. The C output is connected to the RO2 terminal, and to the BD input of a counter 24. The RO terminals provide a set-to-zero state.

The R9 terminals of counter 23 are connected by line 39 to the four R terminals of counter 24 and to ground. The R9 terminals provide a set-to-9 state. The D output of counter 24 is connected to its Ain input, and to the B1 and B2 inputs of a one shot flip-flop 25. The A output of counter 24 is connected to the A input of a counter 40.

Flip-flop 25 is a monostable multivibrator which controls the duty cycle of the minute indicating LED. The A1 and A2 inputs of flip-flop 25 are connected to ground. The G1 terminal is connected to a plus 5 volt source through resistor 27, and to one terminal of capacitor 26. Terminal G2 is connected to the second terminal of capacitor 26. The Q output of flip-flop 25 is connected by way of line 41 to one input of NAND gates 75 and 77, and the Q output is connected to one input of NAND gate 42, which in turn is connected by way of line 99 to the cathode of diode 100, FIG. 2.

Counter 40 serves to produce one output pulse for every ten input pulses. The A output of counter 40 is connected to the BD input, and by way of line 61*a* to the B1 input of a multiplexer 62, FIG. 2. Multiplexer 62 is a quad-two input unit. The RO and R9 inputs of counter 40 are connected to a common ground bus 59 along with the R9 terminals of a counter 43, the R0 and R9 terminals of a counter 44, and the R9 terminals of a counter 45. The B and C outputs of counter 40 are connected by way of lines 61 and 60, respectively, to the B2 and B3 inputs of multiplexer 62. The D output of counter 40 is connected to the Ain input of counter 43, and by way of line 63 to the B4 input of multiplexer 62.

Counter 43 produces one output pulse for every six input pulses. The A output of counter 43 is connected to the BD input terminal, and by way of line 64 to the 1C1 input of a dual-four input multiplexer 57. The B output of counter 43 is connected to the R01 terminal of the counter, and by way of line 65 to the 2C1 input of multiplexer 57. The C output of counter 43 is connected to the R02 terminal, and by way of line 66 to the Ain terminal of counter 44 and the 1C1 terminal of a dual-four input multiplexer 58.

Counter 44 produces one output pulse for every ten input pulses. The A output of counter 44 is connected to the BD input terminal and to line 67. Line 67 leads to line 210 which terminates in one input of NAND gate 68 and to line 217 which terminates in one input of NOR gate 69. Line 67 leads to one input of an exclusive OR gate 70. The B output of counter 44 is connected by way of line 71 through inverter 72 to line 211 which terminates in one input of NAND gate 68. Line 71 also connects to line 216 which terminates in one input of NOR gate 69. Line 71 also is connected to the A2 input of multiplexer 62.

The C output of counter 44 is connected by way of line 73 and line 212 to one input of NAND gate 68, and by way of line 73 and line 215 to one input of NOR gate 69. Line 73 also leads through inverter 74 to one input of NAND gate 75.

The D output of counter 44 is connected to the Ain input of counter 45, and by way of line 76 and line 214 to one input of NOR gate 69. Line 76 is connected through inverter 78 to one input of NAND gate 77, and to line 213 and one input of NAND gate 68.

Counter 45 produces one output pulse for every six input pulses. Output A of counter 45 is connected to the BD input, and by way of line 79 to 1C0 input of multiplexer 57 and to line 82. Line 82 leads to one input of exclusive OR gate 87.

The B output of counter 45 is connected to the R01 terminal and, by way of line 80, to the 2C0 input of multiplexer 57. Line 83 leads to one input of exclusive OR gate 86.

The C output of counter 45 is connected to the R02 terminal, and by way of line 81, to the 1C0 input of multiplexer 58. Line 81 leads to the Ain input of counter 46, and through line 84 to one input of an exclusive OR gate 85.

Counter 46 produces one output pulse for every twelve input pulses. Output A of counter 46 is connected to the BD input and, by way of line 88, through inverter 89 to one input of a NAND gate 93. Line 88 is connected to one input of a NAND gate 90, to one input of a NAND gate 91, and to one input of an exclusive OR gate 92.

The B output of counter 46 is connected to the 1C2 input of multiplexer 57, and to one input of exclusive OR gate 87.

The C output of counter 46 is connected to the R02 terminal, to the 2C2 input of multiplexer 57, and by way of line 160 to one input of exclusive OR gate 86.

The D output of counter 46 is connected to the R01 terminal of the counter, to the 1C2 input of multiplexer 58, and to one input of exclusive OR gate 85 by way of line 159.

The G1 and G2 terminals of multiplexer 57 are connected to ground, as are the G1 and G2 terminals of multiplexer 58. The Y1 and Y2 outputs of multiplexer 57, and the Y1 output of multiplexer 58 are connected by way of lines 156, 157, and 158, respectively, to the A, B, and C inputs, respectively, of a sector decoder 111, FIG. 2.

In FIG. 2 a coincidence comparator 95 receives inputs by way of lines 210–217 which lead to NAND gate 68 and NOR gate 69. The outputs of NAND gate 68 and NOR gate 69 are connected to one input of NAND gates 90 and 93, respectively. The output of NAND gates 90 and 93 are connected in common to a plus five volt source through resistor 96, and to one input of exclusive OR gate 92. The outputs of exclusive OR gates 85, 86, 87, and 92 are each connected to one input of exclusive NOR gate 97. The output of gate 97 is connected by way of line 98 to one input of NAND gate 42 and to one input of exclusive OR gate 70, FIG. 1. The output of NAND gate 42 is connected by way of line 99 to the cathode of diode 100, FIG. 2. The anode of diode 100 is connected to the anode of diode 102, to a plus 5 volt source through resistor 101, and to NAND gates 94 and 91. The output of NAND gate 91 is connected to a second input of NAND gate 94, through resistor 105 to a plus 5 volt source, and to the Y5 output of digit decoder 106. The output of NAND gate 94 is connected to the Y0 output of digit decoder 106.

A free-running relaxation oscillator 50 drives three state counter 49 at around 1000 Hz. Oscillator 50 includes Schmitt Trigger gate 51, resistor 107, and capacitor 52. The output of NAND gate 51 is connected to resistor 107, to NAND gate 53, and to the clock inputs of JK flip-flops 47 and 48. Resistor 107 is connected to the four inputs of Schmitt Trigger gate 51 and to one terminal of capacitor 52. The other terminal of capacitor 52 is connected to ground. The output of NAND gate 53 is connected to the clock input, D, of decoder 111.

A three-state counter 49 includes JK flip-flops 47 and 48. The K input of flip-flop 47 is connected to a plus 5 volt source through resistor 54, to the CLEAR inputs of flip-flops 47 and 48, and to the K input of flip-flop 48. The J input of flip-flop 47 is connected to the $\overline{Q}$ output of flip-flop 48 and to one input of NAND gate 55. The $\overline{Q}$ output of flip-flop 47 is connected to the J input of flip-flop 48, by way of line 108 to one terminal of switch 109, and by way of line 218 to the A select inputs of multiplexers 57 and 58, FIG. 1. The other terminal of switch 109 is connected to ground. The Q output of flip-flop 47 is connected to a second input of NAND gate 55, whose output is connected by way of line 152 through inverter 56 to one input each of NAND gates 75 and 77. The Q output of flip-flop 48 is connected by way of line 104 to the cathode of diode 102 and to line 110, and by way of line 110 to the B select inputs of multiplexers 57 and 58, FIG. 1. The output of NAND gates 75 and 77, FIG. 1, are connected by way of lines 154, 155 to the A3 and A4 inputs, respectively, of multiplexer 62. The S input of multiplexer 62, FIG. 2, is connected to the pole of the SPDT switch 109. The E output of multiplexer 62 is connected to ground. The Y1, Y2, Y3, and Y4 outputs of multiplexer 62 are connected to the A, B, C, and D inputs, respectively, of digit decoder 106.

The Y0-Y5 outputs of sector decoder 111 are connected through a resistor bank 125 to the bases of transistors 119 through 124, respectively. The emitters of transistors 119–124 are connected in common to a plus 5 volt source through resistor 112. Each of the collectors of transistors 119–124 are connected to the anodes of one sector of ten LEDs making up the LED display 126. Display 126 in a preferred embodiment includes six sectors of ten LEDs each. The Y0-Y9 outputs of decoder 106 are connected to the lines 140-149 of display 126, represented as concentric circles on the face of display 126. Each concentric circle is connected to a like positioned diode in each sector. For example, the cathode of LED 127 of sector 129 is connected to display line 140. The cathode of LED 128 of sector 130 is also connected to the display line 140. Likewise the cathode of LED 131 of sector 129 is connected to the display line 141 as is the cathode of LED 132 of sector 130. The anodes of the diodes of each sector are connected in common to the collector of one of the transistors 119–124.

Further power reduction may be realized by decreasing the duty cycle of each display time. The duty cycle may be controlled by inhibiting the display for a period of time during each state of the counter 49. The output of NAND gate 51, FIG. 2, may be connected through inverter 53 to the D input of decoder 111. When the D input of decoder 111 is a one, a code is generated which inhibits all the outputs regardless of the other A, B, and C inputs. Thus, the entire display is inhibited.

In operation, the 60 Hz line through plug 1 provides power and a time-base. The input to rectifier 6 node 5 is applied to Schmitt trigger 21. Resistors 11 and 12 at the input of NAND gate 18 limit the maximum input voltage to less than 5 volts. Resistor 20 connected from the output of NAND gate 19 to the input of NAND gate 18 provides positive feedback to give about 300 millivolts hysteresis. The Schmitt trigger shapes the half-wave rectified signal into a train of square pulses.

The output of oscillator 22 is OR'ed with the 60 Hz line in gate 19 to provide additional clock pulses when either the minute switch 28 or the hours switch 30 is closed. Oscillator 22 provides a simple means for speeding up the clock to set it.

Counter 23 is a divide-by-six counter which when used with counter 24, a divide-by-ten and divide-by-five counter, provides a 1 Hz and a 2 Hz output from the 60 Hz input line. The 2 Hz output from the D output of counter 24 is fed into the B1 and B2 inputs of the one-shot 25, which controls the duty cycle for the flashing minute indicator. The 1 Hz output from the A output of counter 24 is fed into the A input of counter 40, FIG. 1. Counter 40 is a divide-by-ten counter in BCD format which counts seconds. Counter 43 is a divide-by-six BCD format counter which counts tens of seconds. The output of counter 43 is a 1 pulse per minute signal, which is fed into the Ain input of counter 44. Counter 44 is a divide-by-ten counter which counts minutes. Counter 45 is a divide-by-six counter which counts tens of minutes. Both counter 44 and counter 45 are BCD format. Counter 46 is a divide-by-twelve counter which counts hours. The A output of counter 46 is a divide-by-two output, and its B, C, and D outputs are connected for a divide-by-six BCD format. This counter chain provides a convenient and efficient means for multiplexing seconds, minutes, and hours to the display.

Integrated circuits 42, 49, 50, 53, 55, 56, 57, 58, 62, 68, 69, 70, 72, 74, 75, 77, 78, and 95 provide the timing and multiplexing required to take data from counters 40, 43, 44, 45, and 46, and convert that data into an understandable display. Since seconds, minutes, and hours constitute three sources of information, it is necessary to multiplex the information from the counters to the LED display.

JK flip-flops 47 and 48, FIG. 2, and their associated components constitute the three state counter 49. Each state corresponds to one of the three sources of information to be displayed, i.e., seconds, minutes, or hours as shown in Table I. The three state counter is driven from a free-running relaxation oscillator 50 whose frequency need only be fast enough so that no noticeable blinking of the display is observed. In the preferred embodiment 1000 Hz was used.

TABLE I

| Control State | Q47 | Q48 | Display |
|---|---|---|---|
| 1 | 0 | 0 | Minutes |
| 2 | 1 | 0 | Seconds |
| 3 | 0 | 1 | Hours |

Circuits 57 and 58, FIG. 1, are multiplexers whose inputs are connected to the tens of minutes, tens of seconds, and hours outputs of counters 43, 45, and 46. For example, the 1C0, 1C1, and 1C2 inputs of multiplexer 57 are connected, respectively, to the tens of minutes, tens of seconds, and hours outputs of the counters. The 2C0, 2C1, 2C2 inputs of multiplexer 57 and the 1C0, 1C1, 1C2 inputs of multiplexer 58 are also connected, respectively, to the tens of minutes, tens of seconds, and hours outputs of the counters. The Y1 and Y2 outputs of multiplexer 57 and the Y1 output of multiplexer 58 are connected to the A, B, and C inputs, respectively, of sector decoder 111, FIG. 2, a one of six decoder. The six outputs of decoder 111 are in turn connected to inverting buffer transistors 119–124, which are connected to the anodes of the LEDs of sectors 1–6, respectively, of display 126. As only 2 hours occur in each sector, only the three most significant bits of counter 46 (bits B, C, and D) are connected through the multiplexers 57 and 58 to the sector decoder 111 and on to the buffer transistors 119–124. The least significant bit of counter 46, bit A, is used to determine which hour within the sectors will be addressed. For example, the hour indicators for 2:00 o'clock and 3:00 o'clock are both in sector 130. 2:00 o'clock is designated by diode 128 of sector 130 and 3:00 o'clock is designated by diode 219 of sector 130.

Multiplexer 62, FIG. 2, couples the minutes or seconds BCD data to the digit decoder 106, FIG. 2, whose outputs are connected to the cathodes of the LED diodes of each sector in the LED display 126. To select the cathode of the appropriate hour indicator, the least significant bit, bit A of the hour counter 46, is gated through open-collector NAND gates 94 and 91 to the open-collector outputs, 0 and 5, of digit decoder 106.

The minute display state of the three state counter 49 is decoded by gate 55, FIG. 2, and inverted through inverter 56 whose output is connected to the inputs of NAND gates 75 and 77. This provides a simple means for disabling outputs of the digit decoder 106 by generating a four-bit code, the two most significant bits of which are ones. This code gives all one outputs from digit decoder 106. This is significant during the hour display state when the minutes inputs are selected through multiplexer 62. FIG. 2, and gates 56 and 55 control gates 75 and 77 to give a minutes one state which inhibits the outputs of digit decoder 106. This allows the outputs of gates 94 and 91 to determine the hour LED to be addressed. In addition, gates 75 and 77 have inputs connected to line 41 leading from flip-flop 25 which provide a means for exhibiting the minute display during the one shot time, thus giving a blinking minute indicator at a 2 Hz rate.

The coincidence comparator 95 detects when the minute and hour indicators are in the same location. For example, at 1:05 o'clock, 2:10 o'clock, and 3:15 o'clock. When this occurs, the hour indicator is caused to blink the same as the minute indicator by gating the $\overline{Q}$ output of one shot 25 through gate 42, FIG. 1, to the hour multiplexer gates 94 and 91. In addition, when a compare condition occurs, it is necessary to cause an LED next to the hour indicator to flash to indicate the coincidence of the minute and hour indicators. This is accomplished by inserting exclusive OR gate 70 in series with the least significant bit of the ones of minutes counter, counter 44. Thus, when a compare is generated, the least significant bit is inverted, and moves the minute indicator one place clockwise or counter-clockwise of the hour indicator, depending on whether the hour is even or odd. If the hour is odd, the minute indicator will move one place counter-clockwise. If the hour is even, the minute indicator will move one place clockwise.

Figure 3:
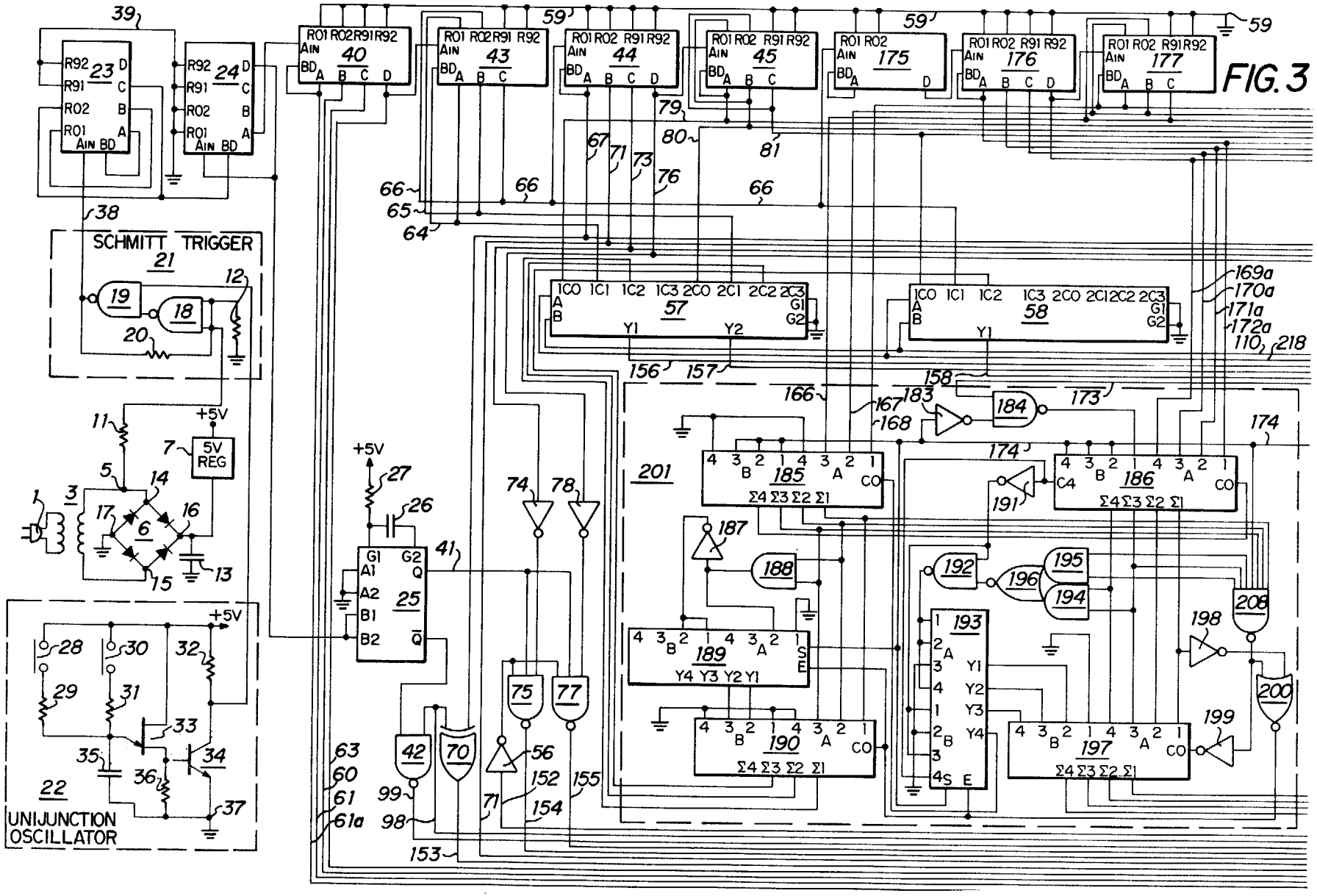
FIGS. 3 and 4 comprise a schematic diagram of the electrical circuit for an embodiment featuring an indexed hour indicator with an alternate hour-minute coincidence display.
Figure 4:
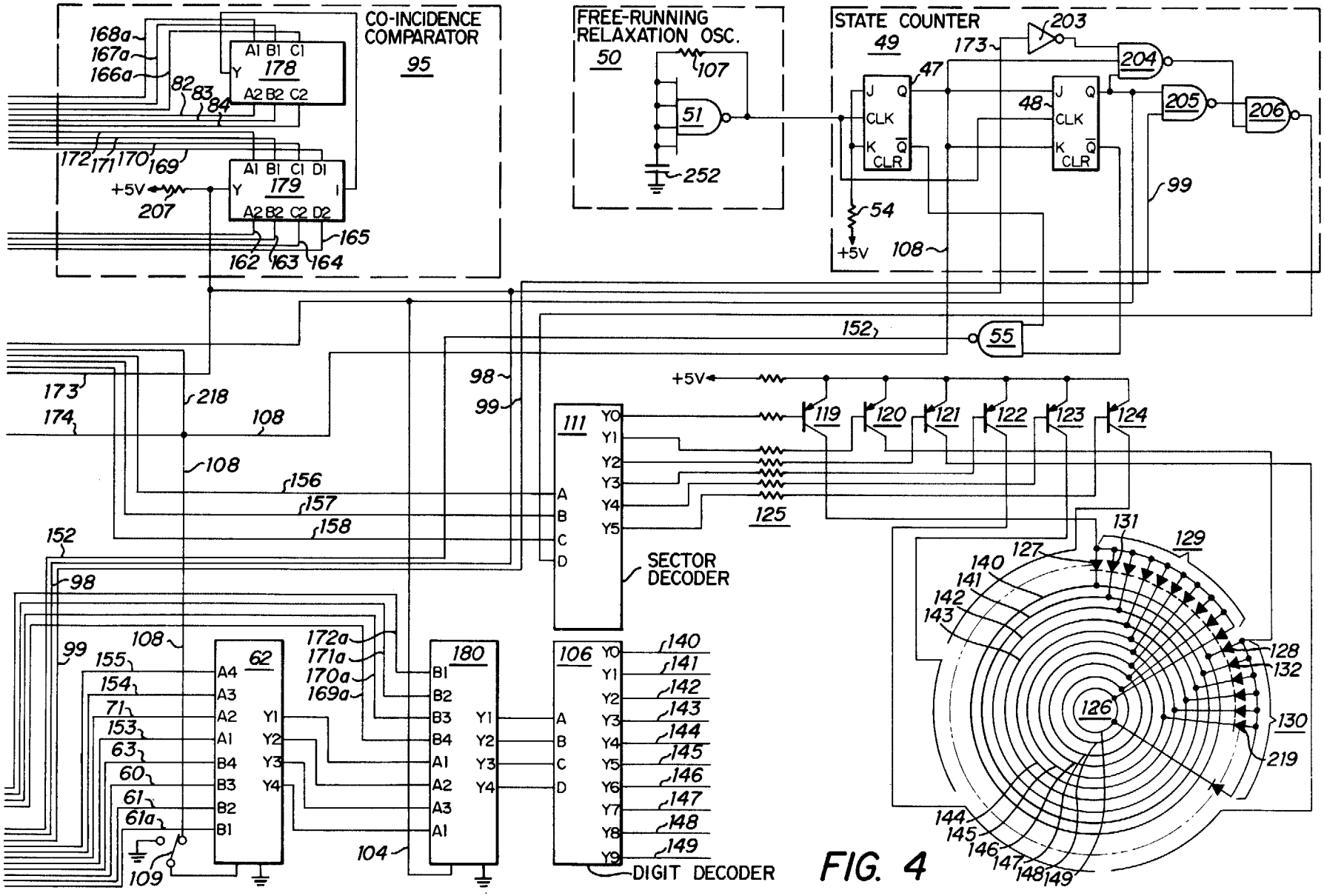

FIGS. 3 and 4

FIGS. 3 and 4 illustrate an embodiment providing a more familiar display in that the hour indicator is indexed each twelve minutes rather than once each hour. When the hour and minute indications coincide, the LEDs on both sides of the hour indicator flash.

FIGS. 3 and 4 reflect modification to FIGS. 1 and 2 in that several devices are eliminated, i.e., NAND gate 68, NOR gate 69, NOR gate 97, exclusive OR gates 85, 86, 87, and 92, NAND gates 90 and 93, NAND gates 94 and 91, inverters 89 and 72, and counter 46. Added is an index hour indicator including counters 175, 176, and 177 of FIG. 3, comparators 178 and 179, and multiplexer 180 of FIG. 4.

To provide a coincidence indicator whereby the LEDs on both sides of the hour indicator are flashed, FIG. 1 is further modified by the addition of the modulo 60 BCD adder-subtracter 201, FIG. 3. FIG. 2 is further modified by reconfiguring JK flip-flops 47 and 48, and adding NAND gates 204, 205, 206, and inverter 203 as shown in FIG. 4.

As the illustrative embodiment has been discussed in detail relative to FIGS. 1 and 2, only the modifications to those figures will be discussed in reference to FIGS. 3 and 4.

Counter 175, FIG. 3, receives its input from the one minute output of counter 43 on line 66, and produces an output for every twelve inputs. The A output of counter 175 is connected to the BD terminal of the counter. The D output of counter 175 is connected to the Ain input of counter 176.

Counter 176 is a divide-by-ten counter which provides the hour position within each two-hour sector of the display. The A output of counter 176 is connected to the BD terminal of the counter, and by way of line 172a to the A1 input of adder 186. The A output is also connected to the A1 input of comparator 179, FIG. 4, by way of line 172. The B output of counter 176 is led by way of line 171a to the A2 input of adder 186, and by way of line 171 to the B1 input of comparator 179. The C output of counter 176 is connected by way of line 170a to the A3 input of adder 186, and by way of line 170 to the C1 input of comparator 179. The D output of counter 176 is connected to the Ain input of counter 177. The D output is also led by way of line 169a to the A4 input of adder 186, and by way of line 169 to the D1 input of comparator 179. The R0 terminals of counters 175 and 176 are connected in common along ling 59 with the R9 terminals of counters 176 and 177 to ground.

Counter 177 is a divide-by-six counter. The A output of counter 177, FIG. 3, is connected to the BD terminal of the counter, and by way of line 168 to the A1 input of adder 185. Output A also is led by way of line 168a to the A1 input of comparator 178, FIG. 4. The B output of counter 177 is connected to the R01 terminal of the counter. Lines 167 and 167a also lead the B output to the A2 input of adder 185 and to the B1 input of comparator 178, respectively. The C output of counter 177 is connected to the R02 terminal of the counter, and by way of lines 166 and 166a to the A3 input of adder 185 and the C1 input of comparator 178, respectively.

Comparator 178 is one of two comparators providing coincidence detection. The A2 input of comparator 178, FIG. 4, is connected to the A output of counter 45 by way of lines 82 and 79. The B2 input of comparator 178 is connected to the B output of counter 45 by way of lines 80 and 83. The C2 input is connected to the C output of counter 45 by way of lines 84 and 81.

Comparator 179 is the second of two comparators providing coincidence detection. The A2, B2, C2, and D2 inputs of comparator 179 are connected to the A, B, C, and D outputs of counter 44 by way of lines 67 and 162, 71 and 163, 73 and 164, and 76 and 165, respectively. The Y output of comparator 178 is directly joined to the I input of comparator 179. The Y output of comparator 179 is connected to a plus 5 volt source through resistor 207 and to line 173. Line 173 leads to line 98 of FIG. 1, to inverter 203, and to one input of NAND gate 184 of the modulo 60 BCD adder-subtracter 201.

The A1, A2, A3, and A4 inputs to multiplexer 180 are directly joined to the Y1, Y2, Y3, and Y4 outputs of multiplexer 62, respectively. The Y1, Y2, Y3, and Y4 outputs of multiplexer 180 are connected to the A, B, C, and D inputs of digit decoder 106. The S terminal or select input of multiplexer 180 is connected by way of line 104 to the Q output of JK flip-flop 48. The E or enable terminal of multiplexer 180 is connected to ground.

The modulo 60 BCD adder-subtracter 201, FIG. 3, increases or decreases the hour position by one when a coincidence occurs. The A4 input of adder 185 is connected in common with the B4 input to ground. The B1, B2, and B3 inputs are joined in common to line 174. The sum 3 output of adder 185 is connected to AND gate 188, to the A3 input of adder 190, and to one input of NAND gate 208. The sum 2 output of adder 185 is connected to a second input of AND gate 188, to the A2 input of adder 190, and to an input of NAND gate 208. The sum 1 output is connected to the A1 input of adder 190, and to an input of NAND gate 208.

AND gate 188 is connected through inverter 187 to the B2 and B1 inputs of multiplexer 189, and is directly connected to the A2 input of multiplexer 189.

The A1 input of multiplexer 189 is connected to ground. The S terminal of multiplexer 189 is connected to line 174, and to the S terminal of multiplexer 193. The E terminal of multiplexer 189 is connected to the C0 or carry input terminal of adder 190, to the E terminal of multiplexer 193, and to the output of NOR gate 200. The Y1 output of multiplexer 189 is connected to the B2 input of adder 190, while the Y2 output is connected to the B3 input of adder 190.

The A4, B1, and B4 inputs of adder 190 are joined in common to ground. The sum 3 output of adder 190 is connected to the 1C2 input of multiplexer 58, FIG. 3. The sum 2 output of adder 190 is connected to the 2C2 input of multiplexer 57, while the sum 1 output is connected to the 1C2 input of multiplexer 57.

Line 174 is connected through inverter 183 and NAND gate 184 to the B1 input of adder 186. The B2, B3, and B4 inputs to adder 186 are joined in common to line 174. The C4 terminal, carry output, of adder 186 is connected to the input of inverter 191, and to the B4 input to multiplexer 193. The C0 terminal, carry input, of adder 186 is connected to the sum 4 output of adder 185.

The sum 4 output of adder 186 is connected to one input of AND gate 195, to one input of AND gate 194, to an input to NAND gate 208, and to the A4 input to adder 197. The sum 3 output of adder 186 is connected to a second input to AND gate 194, to the A3 input of adder 197, and to an input of NAND gate 208. The sum 2 output of adder 186 is connected to a second input of AND gate 195, to the A2 input of multiplexer 197, and to an input of NAND gate 208. The sum 1 output of adder 186 is connected to the A1 input of adder 197 and to the input of inverter 198. The remaining input to NAND gate 208 is connected to line 174.

The outputs of AND gates 194 and 195 are the inputs to NOR gate 196. The outputs of inverter 191 and NOR gate 196 are connected through NAND gate 192 to the A1, A2, and A4 inputs to multiplexer 193. Inverter 191 is also connected to the B1 and B3 inputs of multiplexer 193.

The A3 and B2 inputs to multiplexer 193 are joined in common to ground. The Y1, Y2, and Y3 outputs of multiplexer 193 are connected to the B2, B3, and B4 inputs to adder 197, respectively. The Y4 output of multiplexer 193 is connected to the C0 terminal, carry input, of adder 185.

The B1 input to adder 197 is connected to ground. The sum 1, sum 2, sum 3, and sum 4 outputs of adder 197 are connected to the B1, B2, B3, and B4 inputs to multiplexer 180, respectively. The outputs of inverter 198 and NAND gate 208 are connected to the inputs of NOR gate 200. NAND gate 208 is also connected through inverter 199 to the C0 terminal of adder 197.

The three state counter 49 of FIG. 2 is modified as shown in FIG. 4. The J and K terminals of JK flip-flop 47 are connected in common to a plus 5 volt source through resistor 54. The Q output of flip-flop 47, and the J and K inputs of flip-flop 48 are joined in common to line 174 by way of line 108. The Q output of flip-flop 48 is connected to one input of NAND gate 204 and one input of NAND gate 205 in addition to the aforementioned connections to lines 104 and 110. The out put of inverter 203 and a tie to line 174 by way of line 108 form the other two inputs to NAND gate 204, which in turn is connected to one input of NAND gate 206. A second input to NAND gate 205 is connected to the output of NAND gate 42, FIG. 3, by way of line 99. The output of NAND gate 205 is connected to one input of NAND gate 206. The output of NAND gate 206 is connected to the D input of sector decoder 111, FIG. 4.

In operation, counter 175 is a divide-by-twelve counter whose input is the one minute output of counter 43. Counter 175 thus provides a twelve minute interval count. Counter 176 is a divide-by-ten counter which provides the hour position within each two-hour sector of the display. Counter 177 is a divide-by-six counter which determines the particular sector of the display where the hour is to be displayed. The inner connection of counters 175, 176, and 177 with multiplexer 180 provides the twelve minute hour advance.

Comparators 178 and 179 provide the coincidence detection to determine when the hour and minute indicators are in the same location. A compare must be made between each pair of A, B, C, and D inputs of each comparator for a compare signal to appear on line 173. The comparators consist of open collector, exclusive NOR gates. These circuit modifications allow the hour indicator to move in a more nearly analog fashion from one hour to the next, providing more similarity to a conventional clock display with pointers.

The modulo 60 BCD adder-subtracter 201, the modifications to state counter 49, and the NAND gate 206 input to the sector decoder 111 constitute the circuit to display the coincidence of the minute and hour indicators. When a coincidence occurs, the LEDs on both sides of the hour indicator flash.

The adder-subtractor 201 provides the means for increasing and decreasing the hour position indicators by one position when a compare condition occurs. Unit 201 is a conventional sign-magnitude configuration for handling operations having only positive results.

The modified state counter 49 provides a four-state read-out during a compare or coincidence time as shown in Table 2.

Minutes and seconds are displayed identically as in the preferred embodiment of FIGS. 1 and 2. The hours are displayed only during the Hours (+1) state, when no coincidence between minutes and hours exists and the Hours (−1) is blank. The blanking for Hours (−1) with no coincidence is generated by inverter 203, and gates 204, 205, and 206. For the case when minutes and hours are coincident, Hours (+1) is the time when the LED in the hour position advanced by one is energized, and Hours (−1) is the time when the LED in the hour position decreased by one is energized. During coincidence, the (+1) and (−1) LEDs are flashing.

TABLE II

| Control State | Q47 | Q48 | Display |
|---|---|---|---|
| 1 | 0 | 0 | Minutes |
| 2 | 1 | 0 | Seconds |
| 3 | 0 | 1 | Hours (+1) |
| 4 | 1 | 1 | Hours (−1) |

In accordance with the present invention, there is provided a horologic display of light-emitting diodes arranged in a single ring, and selectively energized to accurately exhibit time and to minimize power requirements.

More particularly, in an illustrative embodiment, a ring of sixty light-emitting diodes are arranged six degrees apart in a single ring to correspond to the conventional clock face. The present hour is displayed as a continuously energized LED, while minutes are displayed by flashing an LED at a 2 Hz rate. Seconds are displayed as a continuously energized LED advancing at one-second intervals about the LED ring. In those instances where the minutes and hour indications are at the same LED location, both the hour and an immediately adjacent LED are flashed simultaneously. A maximum of three LEDs are energized in any one second.

In a further aspect, there is provided an hour indicator in which the LED location is advanced each twelve minutes to provide a more familiar display.

In a still further aspect, there is provided an hour and minute coincidence indication in which LEDs on both sides of the hour indicator flash.

FIG. 5

Figure 5:
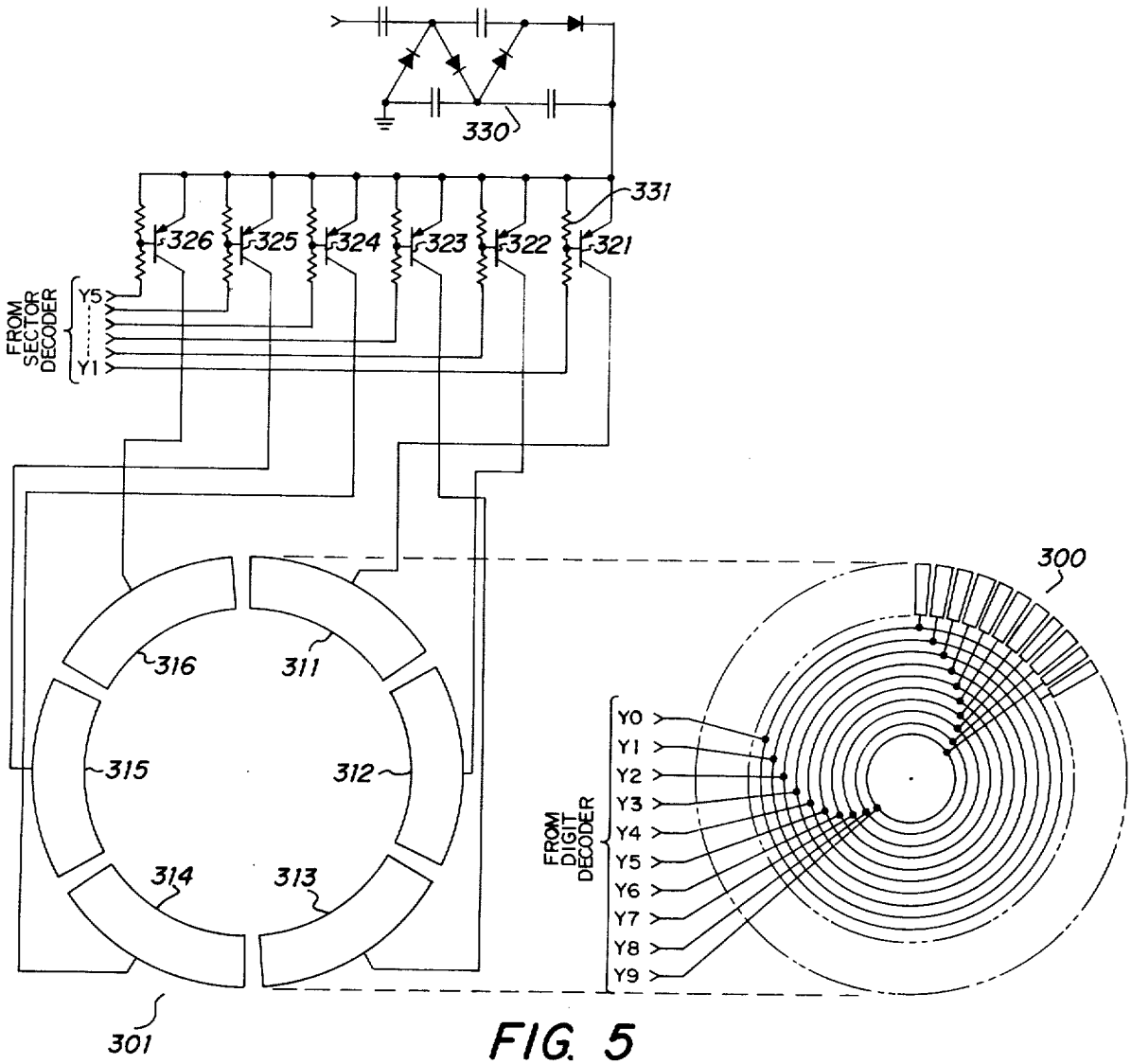
FIG. 5 illustrates a system employing liquid crystal display elements.

In another aspect of the invention, the 60 element LED display is replaced by a liquid crystal display (LCD) to reduce the display power consumption still further. In FIG. 5 an LCD assembly 300 consists of 60 elements. They are in the form of 60 radially disposed bars arranged generally in the same configuration as the LEDs of FIG. 2. The shape of the elements could be made square, triangular, trapezoidal, etc., as desired. The construction of LCD displays per se is well known. The particular configuration of FIG. 5 presents no unique problems. Plate 301 of the LCD would have six sector elements 311–316 corresponding to the anodes of the LEDs and connected to the six sector drivers 321–326. The other plate of the LCD has the 60 individual elements 300 with common connections between corresponding elements of each sector.

The LCD display requires an increased voltage compatible with the display. Generator 330 produces a high display voltage through four stages of voltage multiplication from the source used with the LED embodiment. Base emitter bias resistors, such as resistor 331, provide a turn-off bias for each sector driver transistor when the inputs from the sector decoder are at a logic "1" level. The four-stage voltage multiplier 330 is well known for multiplying an AC signal to obtain higher DC voltages. The input to the multiplier may be a 3.5 to 4 volt peak to peak signal, so the output will be about 14–15 VDC. If the display requires a higher or lower DC voltage, more or fewer stages may be used in the multiplier as needed to accommodate the display.

FIG. 6

Figure 6:
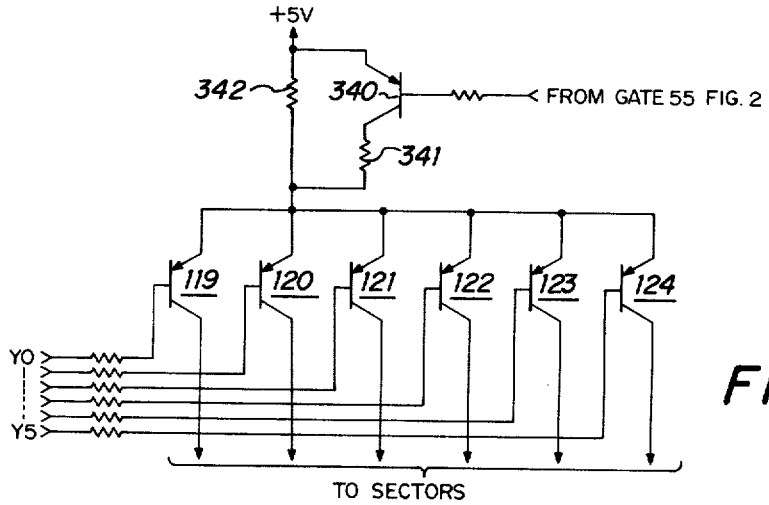
FIG. 6 illustrates a control for producing a variable color display.

FIG. 6 illustrates a further embodiment of the invention. It utilizes LEDs having a characteristic such that at one level of forward bias current the display is red in color. At a distinctly different bias current, the display is green. This configuration enables the hour, minute, or second to be displayed in a different color. Improved readability of the display results. FIG. 6 shows the necessary modifications to FIG. 2 to provide a minute display as a different color from that of the hour and second. An increase in the drive current during the minute multiplex time is employed. In FIG. 6, the increase is effected by use of the output of gate 55, FIG. 2. This output is an "0" logic level during the minute display time. PNP transistor 340 is turned on during the minute display time. The effect is to place resistor 341 in parallel with resistor 342, thus increasing current to the sector drivers 119–124 and to the LEDs. Resistor 342 is selected to give the lower current LED color, while resistor 341 is selected so that the parallel combination of resistors 341 and 342 gives the second color. The display array otherwise would be exactly as shown in FIG. 2.

Having described the invention in connection with certain specific embodiments thereof, it is to be understood that further modifications may now suggest themselves to those skilled in the art and it is intended to cover such modifications as fall within the scope of the appended claims.

What is claimed is:

1. In an electronic timepiece with horologic display, the combination which comprises:

a. a plurality of individually energizable display elements arranged in a single ring; and b. logic means connected to said display elements to display the hour and minute on the same complete display element by indications of different visual character.

2. In an electronic timepiece with horologic display, the combination which comprises:

a. a series of no more than sixty individually energizable display elements arranged in a single ring; and b. logic means connected to said display elements to display the hour and minute on the same complete display element by indications of different visual character.

3. The combination set forth in claim 1 wherein sixty of said elements form said ring.

4. The combination set forth in claim 1 wherein said elements are light-emitting diodes.

5. The combination set forth in claim 1 wherein said elements comprise liquid crystal display elements.

6. The combination set forth in claim 1 wherein means are provided selectively to energize said light-emitting diodes for exhibiting different colors for different time indicators.

7. The combination set forth in claim 1 wherein the element in said ring positionally indicating the hour is energized to exhibit a color different from the element positionally indicating the minute.

8. The combination set forth in claim 1 wherein the elements positionally indicating the hour and minute are characterized by contrasting duty cycles.

9. The combination set forth in claim 1 wherein the element positionally indicating the hour is continuously energized and the element positionally indicating the minute is pulsed.

10. The combination set forth in claim 1 wherein the minute indicator is pulsed at a rate above one per second.

11. In the combination set forth in claim 1, control means to energize said elements sequentially around said ring at a one second space shift rate to provide a visual positional indication of the second distinctive relative to said hour and minute indicators.

12. In the combination set forth in claim 1, control means to advance the position of the hour indicator one element along said ring for every twelve shifts of the minute indicator.

13. In an electronic timepiece with a horologic display of light-emitting elements, the combination which comprises:

a. a plurality of said light-emitting elements arranged in a single ring;

b. a first logic circuit means for energizing only three of said light-emitting elements in any given second to display the second, minute, and hour;

c. a second logic circuit means for indexing said hour display each twelve minutes; and d. a third logic circuit means for indicating the coincidence of hour and minute positions.

14. The combination set forth in claim 13 wherein said elements are 60 in number, equally spaced six degrees apart with control means therefor arranged in six sectors of ten elements per sector.

15. An electronic timepiece with horologic display of light-emitting elements, which comprises:

a. sixty light-emitting diodes equally spaced in a single ring;

b. a first logic circuit means for selecting and energizing said diodes positionally to display the second as a continuously illuminated diode advancing at one second intervals;

c. a second logic circuit means for selecting and energizing said diodes positionally to display the minute as a flashing diode pulsed for illumination at a greater than one Hz rate and advancing at one minute intervals;

d. a third logic circuit means for selecting and energizing said diodes positionally to display the hour as a continuously illuminated diode which advances at hour related intervals;

e. control means to advance said hour indication at twelve minute intervals; and f. a fourth circuit means for intermittently energizing said hour display and an adjacent diode when coincident with the position of the minute indicator.

16. The combination set forth in claim 15 wherein said timepiece includes means for intermittently energizing diodes on both sides of said hour display to indicate coincidence of hour and minute positions.

17. The combination set forth in claim 13 wherein said elements are light-emitting diodes.

18. The combination set forth in claim 13 wherein said elements comprise liquid crystal display elements.

19. The combination set forth in claim 17 wherein means are provided selectively to energize said light-emitting diodes for exhibiting different colors for different time indicators.

20. The combination set forth in claim 19 wherein the element in said ring positionally indicating the hour is energized to exhibit a color different from the element positionally indicating the minute.

21. The combination set forth in claim 13 wherein the elements positionally indicating the hour and minute are characterized by contrasting duty cycles.

22. The combination set forth in claim 21 wherein the element positionally indicating the hour is continuously energized and the element positionally indicating the minute is pulsed.

23. The combination set forth in claim 22 wherein the minute indicator is pulsed at a rate above one per second.

24. The combination set forth in claim 13 wherein control means to energize said elements sequentially about said ring at a one second space shift rate provide a visual position indication of the second distinctive relative to said hour and minute indicators.

25. In the combination set forth in claim 13, control means to advance the position of the hour indicator one element along said ring for every twelve shifts of the minute indicator.

26. A method for displaying time in an electronic watch in which sixty individual visual display elements are arranged in a single ring at six degree intervals, comprising:

a. selectively energizing said elements to display seconds as a continuous energization advancing in one second intervals;

b. selectively energizing said elements to display minutes as a pulsating illumination advancing in one minute intervals;

c. selectively energizing said elements to display hours as a continuous illumination advancing each twelve minutes; and d. signaling the coincidence of hour and minute positions by intermittently illuminating diodes immediately adjacent said display of hours.

27. The method of claim 26 which includes the step of indicating at least one of the hour and minute display in color contrasting with the other.

* * * * *

UNITED STATES PATENT OFFICE

CERTIFICATE OF CORRECTION

Patent No. 3,955,354 Dated May 11, 1976

Inventor(s) Jack S. Kilby et al

It is certified that error appears in the above-identified patent and that said Letters Patent are hereby corrected as shown below:

Col. 3, line 61, "Q" should be --$\overline{Q}$--.
Col. 5, line 51, "$\overline{Q}$" should be --Q--;
line 55, "Q" should be --$\overline{Q}$--.
Col. 9, line 15, "ling" should be --line--.

Signed and Sealed this

Seventeenth Day of August 1976

[SEAL]

*Attest:*

RUTH C. MASON
*Attesting Officer*

C. MARSHALL DANN
*Commissioner of Patents and Trademarks*